US006942544B2

(12) United States Patent
Beaucage et al.

(10) Patent No.: US 6,942,544 B2
(45) Date of Patent: Sep. 13, 2005

(54) METHOD OF ACHIEVING VERY HIGH CROWN-TO-CAMBER RATIOS ON MAGNETIC SLIDERS

(75) Inventors: Jacey Robert Beaucage, San Jose, CA (US); Paul Arthur Goddu, San Jose, CA (US); Jeffrey P. Gunder, Los Altos, CA (US); Eduardo Padilla, San Leandro, CA (US); Huey-Ming Tzeng, San Jose, CA (US); Tsai-Wei Wu, San Jose, CA (US)

(73) Assignee: Hitachi Global Storage Technologies Netherlands B.V., Amsterdam (NL)

( * ) Notice: Subject to any disclaimer, the term of this patent is extended or adjusted under 35 U.S.C. 154(b) by 90 days.

(21) Appl. No.: 10/675,527

(22) Filed: Sep. 30, 2003

(65) Prior Publication Data

US 2005/0070207 A1 Mar. 31, 2005

(51) Int. Cl.[7] ..... B24B 49/00; B24B 51/00

(52) U.S. Cl. ..... 451/7; 451/5; 451/41; 451/53; 451/56; 451/63

(58) Field of Search ..... 451/5, 7, 36, 41, 451/53, 56, 63

(56) References Cited

U.S. PATENT DOCUMENTS 4,010,574 A 3/1977 Feierabend et al.
4,471,579 A * 9/1984 Bovensiepen ..... 451/7
5,365,700 A * 11/1994 Sawada et al. ..... 451/28
5,591,073 A 1/1997 Turgeon
5,718,620 A * 2/1998 Tanaka et al. ..... 451/288
5,782,678 A * 7/1998 Cesna et al. ..... 451/269
5,803,798 A * 9/1998 Cesna et al. ..... 451/269
5,980,685 A 11/1999 Kimura
6,074,283 A 6/2000 Maeda et al.
6,276,991 B1 8/2001 Kobayashi et al.
6,416,384 B1 7/2002 Kawamoto et al.
6,511,365 B2 * 1/2003 Terashima et al. ..... 451/58
6,544,111 B1 4/2003 Kimura et al.
6,579,152 B1 6/2003 Kimura
6,692,341 B2 2/2004 Kishida et al.
2003/0073383 A1 4/2003 Lee et al.

* cited by examiner

*Primary Examiner*—Timothy V. Eley
(74) *Attorney, Agent, or Firm*—Bracewell & Giuliani LLP

(57) ABSTRACT

A method of precisely controlling the amount of flatness or curvature in a lapping plate is disclosed. The lapping plate is formed from two layers of metal alloys, such as tin-antimony and steel. A bimetallic effect is exploited to induce a linear expansion in the plate so that the flatness or curvature of the plate is manipulated with thermal cycling. The plate is machined and charged under very specific and tightly controlled temperatures to produce a very robust, flat plate charge. As temperature cycling induces a linear expansion along a single plane across the plate, the resultant flatness change is scalar with temperature, and can be repeated and controlled. When the plate laps magnetic sliders, the plate can be thermally cycled to produce a conical surface and a high crown-to-camber ratio can be achieved.

18 Claims, 3 Drawing Sheets

METHOD OF ACHIEVING VERY HIGH CROWN-TO-CAMBER RATIOS ON MAGNETIC SLIDERS

BACKGROUND OF THE INVENTION

1. Technical Field

The present invention relates in general to improving the curvature of a lapping plate and, in particular, to an improved method of achieving very high crown-to-camber ratios on magnetic sliders.

2. Description of the Related Art

Magnetic recording is employed for large memory capacity requirements in high speed data processing systems. For example, in magnetic disc drive systems, data is read from and written to magnetic recording media utilizing magnetic transducers commonly referred to as magnetic heads. Typically, one or more magnetic recording discs are mounted on a spindle such that the disc can rotate to permit the magnetic head mounted on a moveable arm in position closely adjacent to the disc surface to read or write information thereon.

During operation of the disc drive system, an actuator mechanism moves the magnetic transducer to a desired radial position on the surface of the rotating disc where the head electromagnetically reads or writes data. Usually the head is integrally mounted in a carrier or support referred to as a "slider." A slider generally serves to mechanically support the head and any electrical connections between the head and the rest of the disc drive system. The slider is aerodynamically shaped to slide over moving air and therefore to maintain a uniform distance from the surface of the rotating disc thereby preventing the head from undesirably contacting the disc.

Typically, a slider is formed with essentially planar areas surrounded by recessed areas etched back from the original surface. The surface of the planar areas that glide over the disc surface during operation is known as the air bearing surface (ABS). Large numbers of sliders are fabricated from a single wafer having rows of the magnetic transducers deposited simultaneously on the wafer surface using semiconductor-type process methods. After deposition of the heads is complete, single-row bars are sliced from the wafer, each bar comprising a row of units which can be further processed into sliders having one or more magnetic transducers on their end faces. Each row bar is bonded to a fixture or tool where the bar is processed and then further diced, i.e., separated into sliders having one or more magnetic transducers on their end faces. Each row bar is bonded to a fixture or tool where the bar is processed and then further diced, i.e., separated into individual sliders each slider having at least one magnetic head terminating at the slider air bearing surface.

The slider head is typically an inductive electromagnetic device including magnetic pole pieces, which read the data from or write the data onto the recording media surface. In other applications the magnetic head may include a magneto-resistive read element for separately reading the recorded data with the inductive heads serving only to write the data. In either application, the various elements terminate on the air bearing surface and function to electromagnetically interact with the data contained on the magnetic recording disc.

In order to achieve maximum efficiency from the magnetic heads, the sensing elements must have precision dimensional relationships to each other as well as the application of the slider air bearing surface to the magnetic recording disc. Each head has a polished ABS with flatness parameters, such as crown, camber, and twist. The ABS allows the head to "fly" above the surface of its respective spinning disk. In general, small (<5 nm), positive crown and camber values are desired to achieve the desired fly height, fly height variance, take-off speed, and other aerodynamic characteristics. However, there are applications that call for very high crown values in order to reduce the stiction force between head and disk when the disk is stopped. There are also applications that require negative crown values to promote the slider to contact with the disk during read/write operations. During manufacturing, it is most critical to grind or lap these elements to very close tolerances of desired flatness in order to achieve the unimpaired functionality required of sliders.

Conventional lapping processes utilize either oscillatory or rotary motion of the workpiece across either a rotating or oscillating lapping plate to provide a random motion of the workpiece over the lapping plate and randomize plate imperfections across the head surface in the course of lapping. During the lapping process, the motion of abrasive particles carried on the surface of the lapping plate is typically along, parallel to, or across the magnetic head elements exposed at the slider ABS.

Rotating lapping plates having horizontal lapping surfaces in which abrasive particles such as diamond fragments are embedded have been used for lapping and polishing purposes in the high precision lapping of magnetic transducing heads. Generally in these lapping processes, as abrasive slurry utilizing a liquid carrier containing diamond fragments or other abrasive particles is applied to the lapping surface as the lapping plate is rotated relative to the slider or sliders maintained against the lapping surface.

Although a number of processing steps are required to manufacture heads, the ABS flatness parameters are primarily determined during the final lapping process. The final lapping process may be performed on the heads after they have been separated or segmented into individual pieces, or on rows of heads prior to the segmentation step. This process requires the head or row to be restrained while an abrasive plate of specified curvature normal to the surface is rubbed against it. As the plate abrades the surface of the head, the abrasion process causes material removal on the head ABS and, in the optimum case, will cause the ABS to conform to the contour or curvature of the plate. The final lapping process also creates and defines the proper magnetic read sensor and write element material heights needed for magnetic recording.

There are a number of factors that affect the accuracy of ABS curvature during the final lapping process. These include diamond size/morphology, lubricant chemistry, lapping surface velocity, plate material, lapping motion/path on the plate, and other lapping parameters. In addition to these parameters, it is essential that the contour of the lapping plate be tightly controlled since, in the best case, the ABS will conform to the curvature of the plate. Thus, the flatness and/or curvature of the slider ABS exhibits a strong dependency on the curvature of the lapping plate used. For a given plate, the lapping property of the plate changes every time the plate is refaced and recharged. It is known in the trade that a so-called "good plate" is key to achieve consistent and within-specification slider flatness. Likewise, it is not uncommon to see a so-called "bad plate" cause unacceptable sliders.

In the plate charging operation, the plate is covered with a layer of diamond-containing slurry. A charge ring, made of ceramic material that is harder than the plate material while softer than diamond, sits on the plate and pushes the diamond grits into the plate material as the plate and ring turn. In the early phase of the charging process, the contact surface between a charge ring and a plate is primarily determined by the charge ring contour. After a plate is fully charged with diamond grits, it starts to modify the contour of the charge ring according to the plate surface profile. It is very common to see an out-of-specification plate modify the charge ring shape such that it is no longer possible to maintain its original shape.

In the prior art, vacuum or mechanically-distorted plates can be charged with complementary contour charge rings so that even charging can be achieved on the plates. It is difficult to maintain such exacting matched plates and charges. Furthermore, the plate contour is not a conical one and exhibits second order flatness deviations on the plate, which degrade slider parametrics in addition to crown. Thus, it would be highly desirable to control the lapping property of a lapping plate after it is charged so that a desired amount of precise flatness or curvature of the plate can be predetermined.

SUMMARY OF THE INVENTION

One embodiment of a method of precisely controlling the amount of flatness or curvature in a lapping plate uses a lapping plate material with a linear expansion coefficient of 23-x-$10^{-6}$/° C. bonded to a base with a linear expansion coefficient of 10-x-$10^{-6}$/° C. For example, one embodiment of the invention uses a tin-antimony (SnSb) alloy on a SS440C steel base. With this design, a bimetallic effect is exploited to induce a linear expansion in the plate so that the flatness or curvature of the plate is manipulated with thermal cycling. The plate is machined and charged under very specific and tightly controlled temperatures. The plate temperature is controlled so that plate contour is a flat one when it is charged. This control allows a very robust, flat plate charge.

During lapping, the lapping tool chamber temperature can be regulated to the desired temperature so that specific curvatures are produced to induce high crown values on the sliders. As temperature cycling induces a linear expansion along a single plane across the plate, the resultant flatness change is scalar with temperature, and can be repeated and controlled. For example, with a plate temperature that is 5° C. higher than the ambient temperature, a plate with the aforementioned composition concaves upward with a sag of about 2.5 um over the lapping area. Such a plate produces sliders that have a 15+/−1.5 nm crown while the camber is around 5 nm. In essence, the amount of flatness or curvature of the plate can be "dialed in." The materials used are metals and not subject to significant volumetric distortion.

As the plate is lapping magnetic sliders, the plate can be thermally controlled to produce a conical surface. This is a very desirable effect as a high crown-to-camber ratio can be achieved. With prior art designs, this is not possible since a conical plate is extremely difficult to charge and control. Moreover, in a plate constructed in accordance with the present invention, the plate temperature can be adjusted during the charge process to selectively charge different areas in a dictated order. For example, the middle diameter portion of the plate could be charged first, and then the inner diameter and/or outer diameter portion.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DETAILED DESCRIPTION OF THE INVENTION

Figure 1:
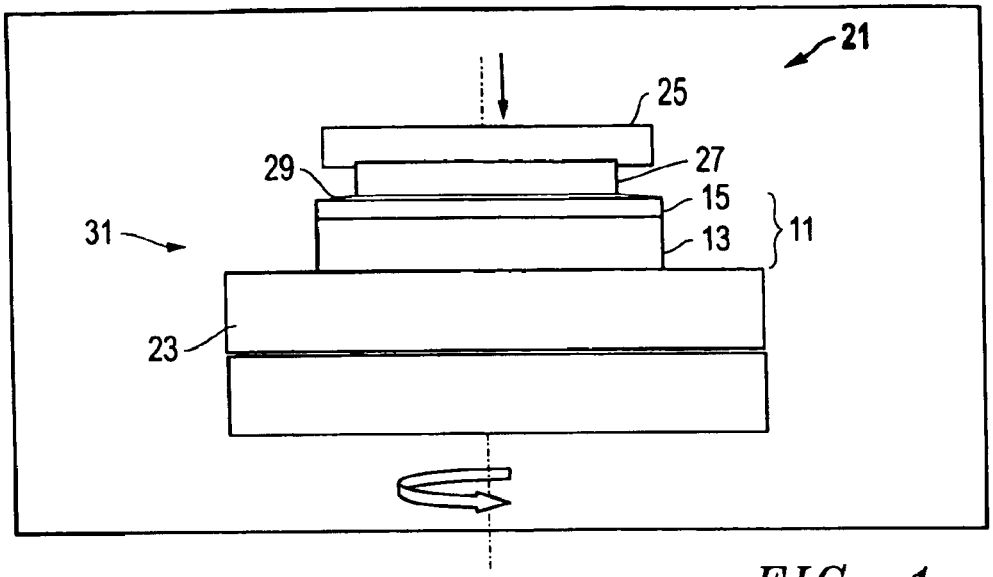
FIG. 1 is a side view of a lapping plate constructed in accordance with the present invention.
Figure 2:
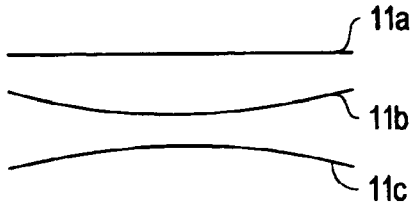
FIG. 2 illustrates three side views of the lapping plate of FIG. 1.
Figure 3:
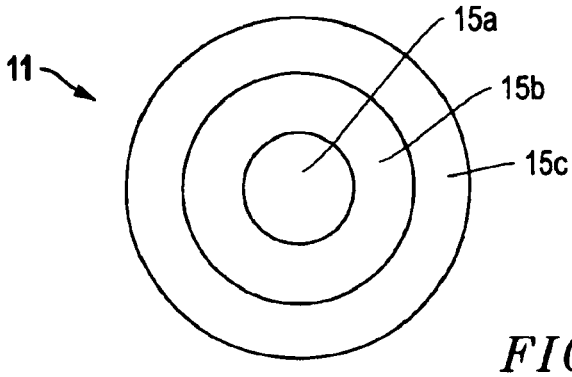
FIG. 3 is a top view of the lapping plate of FIG. 1.

Referring to FIG. 1, one embodiment of a system, method, and apparatus for precisely controlling an amount of flatness or curvature of a lapping plate is disclosed. The lapping plate 11 comprises a base 13 formed from a first metal alloy, and a second metal alloy 15 formed on the base 13. The first and second metal alloys 13, 15 have different coefficients of linear expansion so that a bimetallic effect is exploited to induce a linear expansion in the lapping plate 11. In one embodiment, the base 13 is SS440C steel, and the second metal alloy 15 is tin-antimony. The base 13 has a linear expansion coefficient of 10-x-$10^{-6}$/° C., and the contact layer (alloy 15) has a linear expansion coefficient of 23-x-$10^{-6}$/° C. A flatness or curvature of the lapping plate 11 is manipulated with thermal cycling. The lapping plate 11 may be configured (FIG. 2) in a flat 11*a*, concave 11*b*, or convex 11*c* shape.

Figure 4:
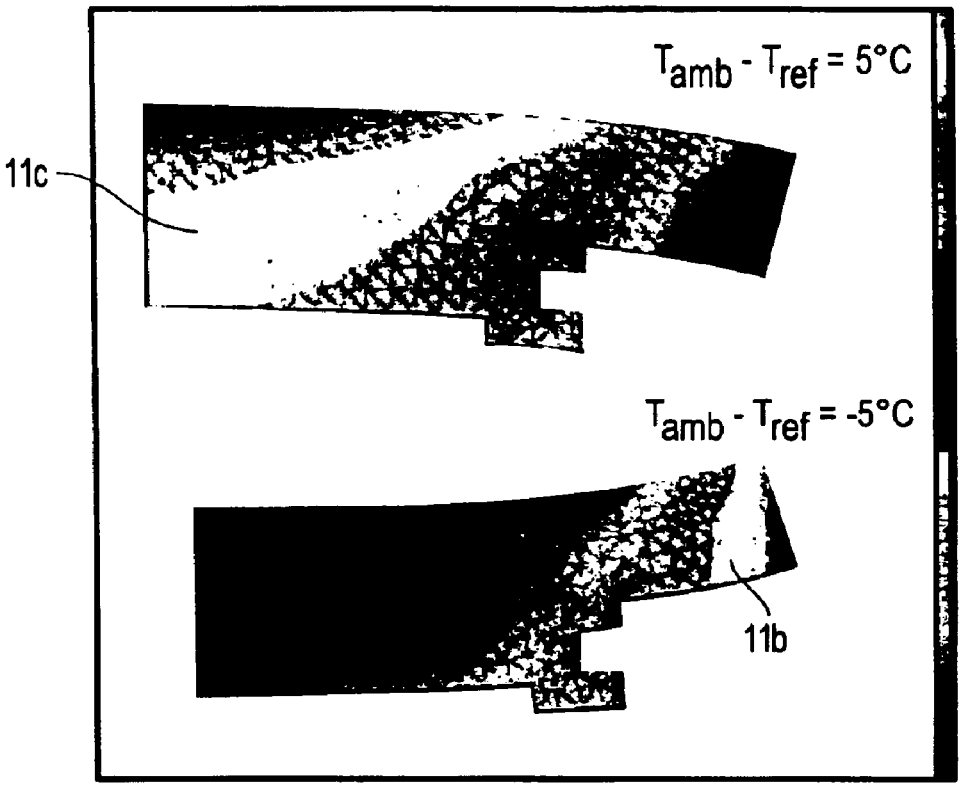
FIG. 4 is a digital side image of a finite element analysis of a portion of the lapping plate of FIG. 1 contrasting the effect of temperature changes on the lapping plate.
Figure 5:
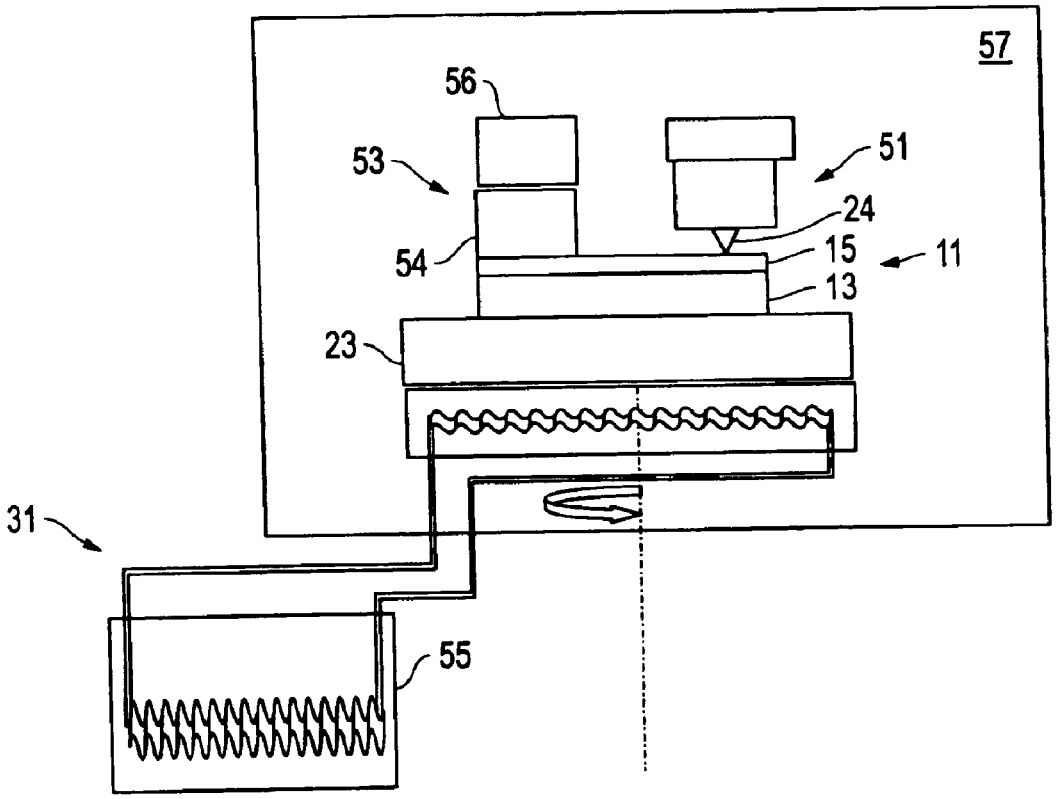
FIG. 5 is a schematic side view of a facing and charging tool constructed in accordance with the present invention.

To achieve a flat surface, the plate temperatures are maintained at room temperature via thermal control means 31 (FIG. 5) during facing 51 and charging 53 in one embodiment. The facing tool 51 has a diamond-tipped cutter 24. The charging system 53 has a charge ring 54 and a load-exerting unit 56. To achieve a concave contour, the plate temperature during facing is kept at a temperature higher than the room temperature with heated chuck and tool chamber 57. To achieve a convex contour, the plate temperature during facing is kept at a temperature lower than the room temperature with chilled chuck and tool chamber 57. FIG. 4 is a digital side image of a finite element analysis of a portion of the lapping plate 11 contrasting the effect of temperature changes on the shape of lapping plate 11.

Referring again to FIG. 1, the lapping plate 11 forms part of a system 21 (not drawn to scale) for precisely controlling the amount of flatness or curvature of the lapping plate 11. The system 21 comprises a rotatable platform 23 to which the lapping plate 11 is mounted and rotates with. A holder 25 is used to hold one or more workpieces 27, such as a magnetic slider (e.g., a GMR slider), against the lapping plate 11 so that an abrasive slurry 29 can be used to lap the workpiece 27.

The system 21 also comprises a device 31 or means for controlling the temperature of the lapping plate 11 and thereby precisely manipulating an amount of flatness or curvature of the lapping plate 11. Device 31 may comprise a temperature regulating unit that circulates fluid that travels between a thermal bath 55 (FIG. 5) and the chuck 23 holding the plate 11 during facing 51. The interior air temperature of the facing tool 51 is also regulated during facing. As a result, the temperature of the lapping plate 11 thereby precisely manipulates an amount of flatness or curvature of the lapping plate 11. In addition, the temperature of the workpiece 27 (FIG. 1) and the abrasive slurry 29 can be controlled via the same system along with the temperature of the lapping plate 11. As described above, the system 21 exploits the bimetallic effect to induce linear expansion in the lapping plate 11 so that the flatness or curvature of the lapping plate 11 is manipulated with thermal cycling.

The system 21 uses the lapping plate 11 to give the workpiece 27 a high crown-to-camber ratio. The temperature of the lapping plate 11 is adjusted during a charge process (FIG. 5) to selectively charge different areas of the lapping plate in a dictated order. For example, a middle diameter portion 15*b* of the lapping plate 11 is charged first, and then an inner diameter portion 15*a* of the lapping plate 11 and/or an outer diameter portion 15*c* of the lapping plate 11. The lapping plate 11 can also give the workpiece 27 a negative crown and positive camber values.

In operation (FIG. 1), the present invention comprises a method of precisely controlling the amount of flatness or curvature of the lapping plate 11 in order to achieve a desired shape on the workpieces 27. The method comprises lapping the workpiece(s) 27 with the lapping plate 11, and controlling the temperature of the lapping plate 11 to precisely manipulate an amount of flatness or curvature of the lapping plate 11. The method comprises exploiting the bimetallic effect to induce a linear expansion in the lapping plate 11 so that the flatness or curvature of the lapping plate 11 is manipulated with thermal cycling.

The method may include configuring the lapping plate 11 in a flat, concave, or convex shape and giving the workpiece 27 a high crown-to-camber ratio. The method optionally includes adjusting the temperature of the lapping plate 11 during the charge process to selectively charge different areas of the lapping plate in a dictated order, as described above. The method also may comprise controlling a temperature of the workpiece 27 and the abrasive slurry 29 along with the temperature of the lapping plate 11.

The present invention has several advantages, including the ability to precisely control the amount of flatness or curvature in a lapping plate. The invention exploits the bimetallic effect to induce linear expansion in the plate so that the flatness or curvature of the plate is manipulated with thermal cycling. The machining and charging control allows a very robust, flat plate charge. As temperature cycling induces a linear expansion along a single plane across the plate, the resultant flatness change is scalar with temperature. Consequently, the amount of flatness or curvature of the plate can be precisely dialed into plate, and a high crown-to-camber ratio can be achieved. In addition, the plate temperature can be adjusted during the charge process to selectively charge different areas in a dictated order.

While the invention has been shown or described in only some of its forms, it should be apparent to those skilled in the art that it is not so limited, but is susceptible to various changes without departing from the scope of the invention.

What is claimed is:

1. A method of precisely controlling an amount of flatness or curvature of a lapping plate, the method comprising:

(a) providing a lapping plate and a workpiece;

(b) lapping the workpiece with the lapping plate;

(c) controlling a temperature of the lapping plate to precisely manipulate an amount of flatness or curvature of the lapping plate; and (d) adjusting the temperature of the lapping plate during a charge process to selectively charged different areas of the lapping plate in a dictated order to manipulate the flatness or curvature of the lapping plate.

2. The method of claim 1, wherein step (c) comprises exploiting a bimetallic effect to induce a linear expansion in the lapping plate so that the flatness or curvature of the lapping plate is manipulated with thermal cycling.

3. The method of claim 1, wherein step (a) comprises providing the workpiece as a magnetic slider.

4. The method of claim 1, wherein step (c) comprises configuring the lapping plate in a flat, concave, or convex shape.

5. The method of claim 1, further comprising giving the workpiece a high crown-to-camber ratio.

6. The method of claim 1, further comprising charging a middle diameter portion of the lapping plate first, and then charging an inner diameter portion of the lapping plate and/or en outer diameter portion of the lapping plate.

7. The method of claim 1, wherein step (c) comprises controlling a temperature of the workpiece and an abrasive slurry along with the temperature of the lapping plate.

8. The method of claim 1, wherein step (a) comprises forming the lapping plate from a plurality of layers of materials having different coefficients of linear expansion.

9. The method of claim 8, wherein step (a) comprises forming the layers from metal alloys.

10. A method of precisely controlling an amount of flatness or curvature of a lapping plate, the method comprising:

(a) providing a lapping plate and a workpiece, the lapping plate having a plurality of layers of materials having different coefficients of linear expansion comprising a tin-antimony alloy and a steel alloy base;

(b) lapping the workpiece with the lapping plate; and (c) controlling a temperature of the lapping plate to precisely manipulate an amount of flatness or curvature of the lapping plate.

11. A method of precisely controlling an amount of flatness or curvature of a lapping plate, the method comprising:

(a) forming a lapping plate from a plurality of layers of materials having different coefficients of linear expansion;

(b) lapping a slider with the lapping plate; and (c) controlling a temperature of the lapping plate to precisely manipulate an amount of flatness or curvature of the lapping plate by exploiting a bimetallic effect to induce a linear expansion in the lapping plate so that the flatness or curvature of the lapping plate is manipulated with thermal cycling.

12. The method of claim 11, wherein step (c) comprises configuring the lapping plate in a flat, concave, or convex shape.

13. The method of claim 11, further comprising giving the slider a high crown-to-camber ratio.

14. The method of claim 11, further comprising adjusting the temperature of the lapping plate during a charge process to selectively charge different areas of the lapping plate in a dictated order.

15. The method of claim 14, further comprising charging a middle diameter portion of the lapping plate first, and then charging an inner diameter portion of the lapping plate and/or an outer diameter portion of the lapping plate.

16. The method of claim 11, wherein step (c) comprises controlling a temperature of the slider and an abrasive slurry along with the temperature of the lapping plate.

17. The method of claim 11, wherein step (a) comprises forming the layers from metal alloys.

18. The method of claim 11, wherein step (a) comprises forming the layers from a tin-antimony alloy and a steel alloy base.

* * * * *